United States Patent [19]

Kleinschmidt et al.

[11] 4,094,260

[45] June 13, 1978

[54] METHOD AND APPARATUS FOR AUTOMATIC SEWING

[75] Inventors: Johann Otto Kleinschmidt, Karlsruhe; Wolfgang Niem, Leonberg, both of Germany

[73] Assignee: Union Special G.m.b.H., Stuttgart, Germany

[21] Appl. No.: 713,949

[22] Filed: Aug. 12, 1976

[30] Foreign Application Priority Data

| | | |
|---|---|---|
| Aug. 14, 1975 | Germany | 2536260 |
| Jun. 5, 1976 | Germany | 2625503 |
| Jun. 5, 1976 | Germany | 2625504 |

[51] Int. Cl.[2] ..... D05B 27/04

[52] U.S. Cl. ..... 112/121.15; 112/262

[58] Field of Search ..... 112/112.15, 203, 207, 112/212, 153, 262, 121.29; 271/274

[56] References Cited

U.S. PATENT DOCUMENTS

| | | | |
|---|---|---|---|
| 3,404,646 | 10/1968 | Des Ormeaux | 112/212 |
| 3,669,048 | 6/1972 | Dunn et al. | 112/212 X |
| 3,761,073 | 9/1973 | Brain | 112/121.15 X |
| 3,955,515 | 5/1976 | Elsas | 112/121.15 |

*Primary Examiner*—Peter Nerbun

*Attorney, Agent, or Firm*—John W. Harbst; J. Arthur Swanson; John A. Schaerli

[57] ABSTRACT

A method and apparatus for automatically and continually feeding workpieces, one after another, to a sewing machine. The continuous feeding is imparted to the workpiece by a plurality of connecting links which connect the trailing edge of one workpiece with the leading edge of the following workpiece at a point in front of the sewing instrumentalities. The workpiece that is being fed into and through the machine automatically draws the succeeding workpiece towards and through the machine due to the connecting link fastening these two together. Motion is imparted to the connecting links by the feed device associated with the sewing machine. The connecting links are guided through a predetermined path by a rail system which automatically returns the connecting link to a staging area after same has been released from the workpiece. A sewing machine fastens together the continguous ends of the workpieces and a cutter cuts the chain formed therebetween.

35 Claims 30 Drawing Figures

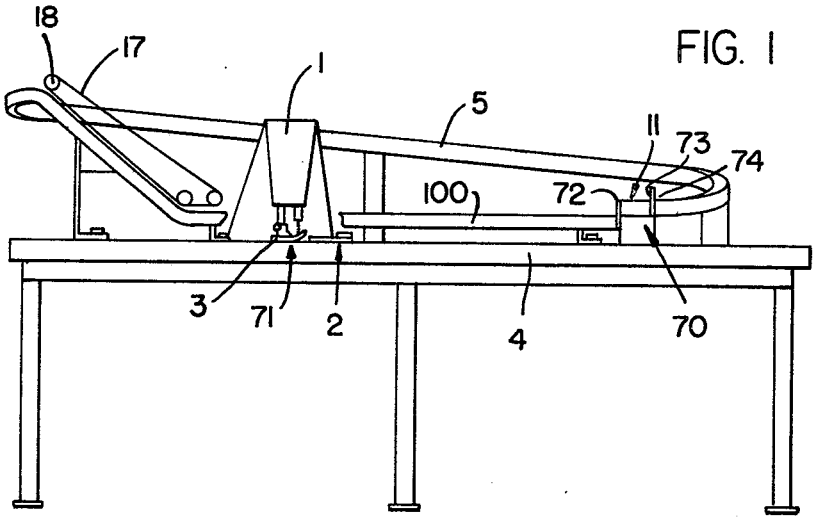
FIG. 1
FIG. 2
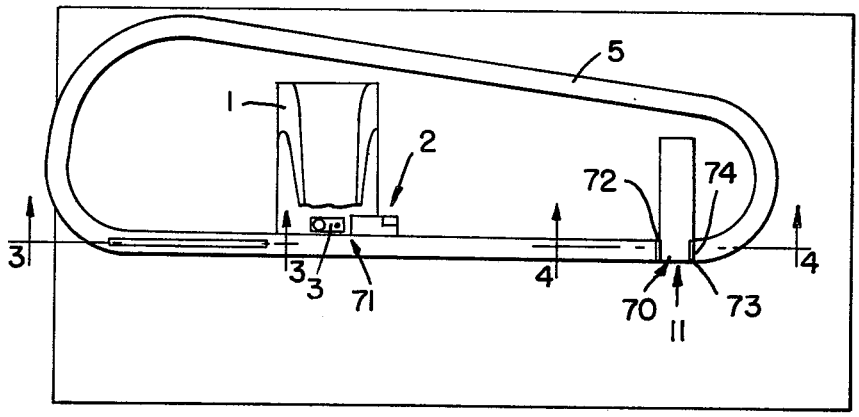
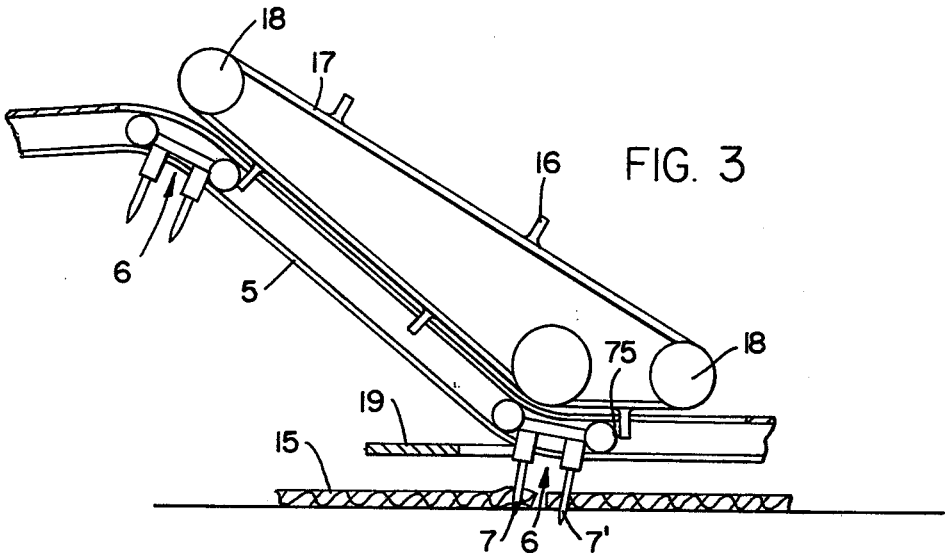
FIG. 3

FIG. 8
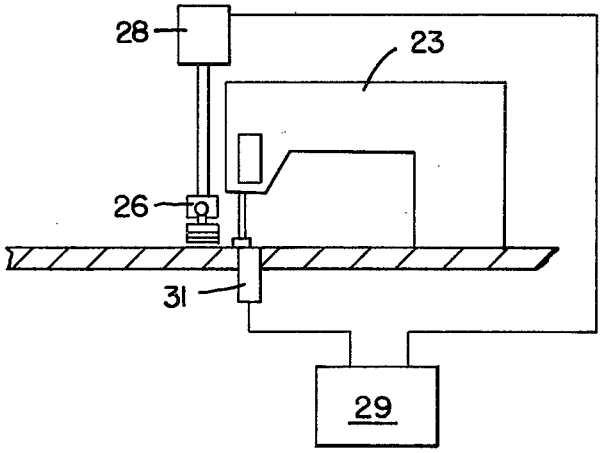
FIG. 10
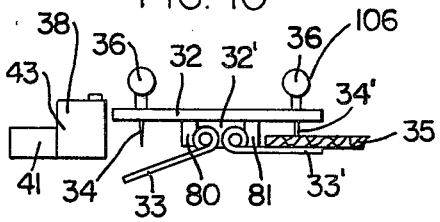
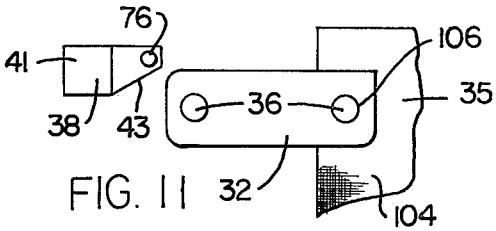
FIG. 11
FIG. 9
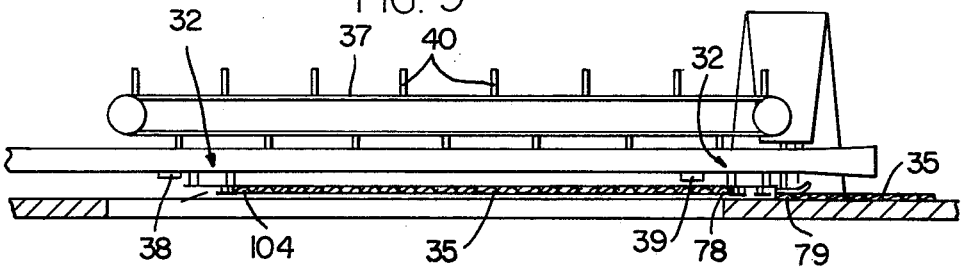
FIG. 12
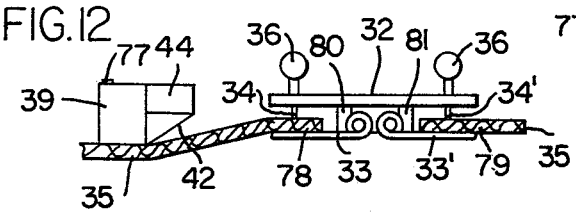
FIG. 13
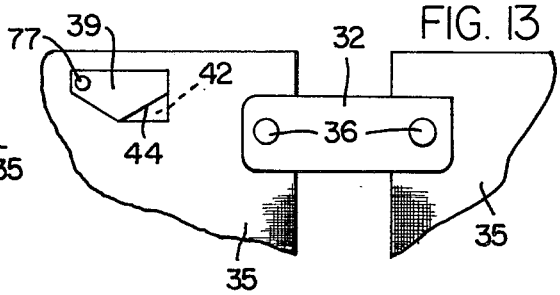
FIG. 30
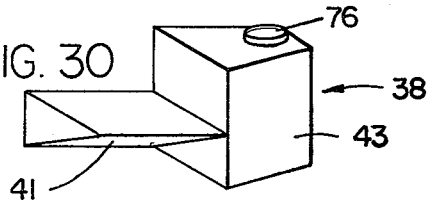
FIG. 14
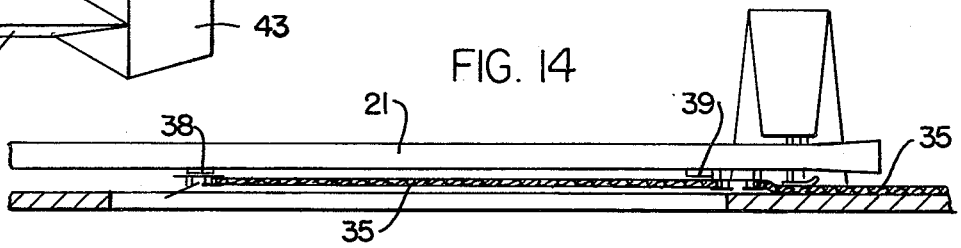
FIG. 15
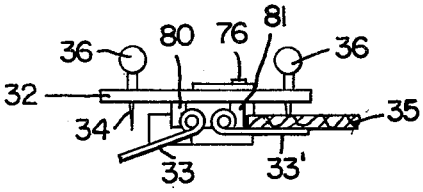
FIG. 16
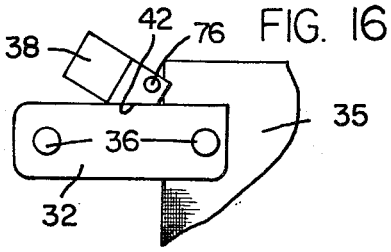

METHOD AND APPARATUS FOR AUTOMATIC SEWING

This invention relates to automatic feeders for workpieces or the like, and more particularly relates to a novel method and apparatus for continually feeding and positioning successive portions of workpieces to and through a sewing machine for a sewing operation along an edge of each workpiece.

BACKGROUND OF THE INVENTION

Various methods for the automatic sewing of a succession of material workpieces along one edge has become known. With these methods the material workpieces are either laid by the operator directly under the presser foot or they are fed to a feed station situated in front of the sewing machine and then automatically fed into the sewing machine.

In the instance where the material workpieces are laid directly under the presser foot the object of the sewing installation depends mainly upon the skill of the operator, that is, while the material is placed beneath the sewing machine presser foot the sewing machine itself is standing still thus no productivity is possible. It has already been proposed to connect a feed station in front of the sewing machine. Even with a feed station connected in front of the sewing machine the amount of time yielded to the operator is only equal to that amount of time which it takes for the feed mechanism to advance from its forward position to its backward position and the operator is dependent on this cycle time.

It is also known in the art for the operator to place the material workpieces on a continually running belt which advances the same into the sewing area. With this method, which is also considerably influenced by the cycle time of the sewing machine, the pieces of material must be laid on the moving support exactly as they are to be presented to the sewing instrumentalities. As may be appreciated, with this type of device it is more difficult to align the pieces of material workpieces in the correct manner and is greatly dependent upon the skill of the operator.

Yet another type of device which has been known in the art is to place the material within a plurality of clamps which are rotated underneath the sewing machine and feed the material thereto. With this installation the time for loading the clamps is dependent upon the cycle time of the sewing machine. Furthermore, a device of this sort is suitable only for small pieces.

SUMMARY OF THE INVENTION

Briefly described, the present invention comprises a method and apparatus for continually and automatically feeding successive workpieces to and through a sewing machine which performs a sewing operation along an edge of each workpiece. Prior to the stitch forming instrumentalities the material workpieces are temporarily secured together by a plurality of connecting links. The connecting links are secured to the material workpiece such that one portion of the connecting link is engaged with the trailing edge of the workpiece while the second portion of the connecting link is engaged with the beginning edge of the next workpiece. In this manner the material workpieces are connected before the stitch point whereby the leading workpiece draws the following workpiece to and through the guide mechanism situated in front of the sewing area and through the sewing area by the feeding of the sewing machine. This feeding moves the workpieces beyond the sewing point. Once the material workpieces have passed through the stitch forming area they are released therefrom in such a manner that the pieces of material themselves form the means of conveyance. With an embodiment of this sort, it is possible to feed the material workpieces independently of the cycle time of the sewing station.

The invention hereunder consideration includes a first station for feeding and connecting edges of the material workpieces which are aligned with one another. The first station is positioned at an area remote from the sewing instrumentalities. A second station is positioned at the rear of the sewing station and has for its purpose to release the temporary connection formed between the material workpieces. The connecting link means are guided in an endless rail which is associated with a conveyor mechanism for conveying the connecting link out of the sewing area and return the same to the first station. The first station forms a staging area for the connecting links. Once the connecting link has been returned from the sewing area via the closed loop rail they are positioned, as required within an oscillatory stapling device.

The connecting link assembly means is preferably formed with two needles that are connected together. As previously stated, the connecting links are collected within a staging area at the first station which is remotely located relative the sewing instrumentalities. As required, an individual connecting link is placed within the stapling device. The stapling device is oscillated whereby temporarily securing the connecting link means with the workpieces such that one of the pins is temporarily secured into the trailing edge of one workpiece while the second pin is temporarily secured within the beginning edge of the succeeding workpiece. The workpieces which are now temporarily secured together are delivered by the operator or advanced by the operator into the guide rail wherein they guide the workpiece until motion is imparted to the leading workpiece by the feed mechanism of the sewing machine, and thus the pieces are fed one after another up to and through the sewing instrumentalities. In this manner the material workpieces which are temporarily connected together by the connecting links at a point remote from the sewing area may be telescoped together but yet guided in such a way that a buffer is formed in front of the stitch point, wherein the buffer is comprised of several pieces of material which are connected together.

In view of the foregoing, the present invention has for an object to provide a novel method and apparatus for automatically and continually feeding material workpieces one after another to and through a sewing machine.

Another object of this invention is to provide the means for temporarily connecting the edges of material workpieces such that the advancement of one workpiece will result in the forced movement of the following workpiece.

Another object of this invention is to provide the means for temporarily connecting and guiding the workpieces into alignment with the sewing instrumentalities with the edges of the materaial workpieces being parallel during the passage through the sewing area.

It is yet another object of this invention to provide a guide means which is displaceable from the direction of feed according to the contour of the edge of the material workpieces associated with it at that time.

It is yet another object of this invention to provide for a program control means which is coupled with sensors which scan the course of the edges of the workpieces as they enter into the sewing area whereby pivoting the rail accordingly.

The above description, as well as for their objects, features and advantages or the present invention will be more fully appreciated by reference to the following detailed description of a number of presently preferred, but nonetheless illustrated embodiments in accordance with the present invention, when taken in conjunction with the accompanying drawings wherein:

FIG. 1 is a front elevational view diagramatically illustrating the apparatus;

FIG. 2 is a top plan view showing the closed loop arrangement schematically represented in FIG. 1;

FIG. 3 is a sectional view taken along line 3—3 of FIG. 2 showing in detail the return conveyor mechanism;

FIG. 8 is an end elevational view taken along line 8—8 of FIG. 7;

FIG. 9 is a fragmentary front elevational view partially shown in section showing the apparatus for controlling the movement of the feeding device;

FIG. 10 is a fragmentary front elevation detail view showing the second material releasing device of the device in FIG. 9;

FIG. 11 is a fragmentary top plan detail view of the material releasing device as shown in FIG. 10;

FIG. 12 is a fragmentary front elevation detail view showing the first material releasing device of the device in FIG. 9;

FIG. 13 is a fragmentary top plan detail view of the material releasing device as shown in FIG. 12;

FIG. 14 is a fragmentary front elevation view showing the material releasing device in a second position;

FIG. 15 is a fragmentary front elevation detail view showing the second material releasing device where there is contact between the second opener and one carrier;

FIG. 16 is a fragmentary top plan detail view showing the device in FIG. 15;

FIG. 30 is a perspective view showing second releasing block.

DESCRIPTION OF THE PREFERRED EMBODIMENT

Figure 5:
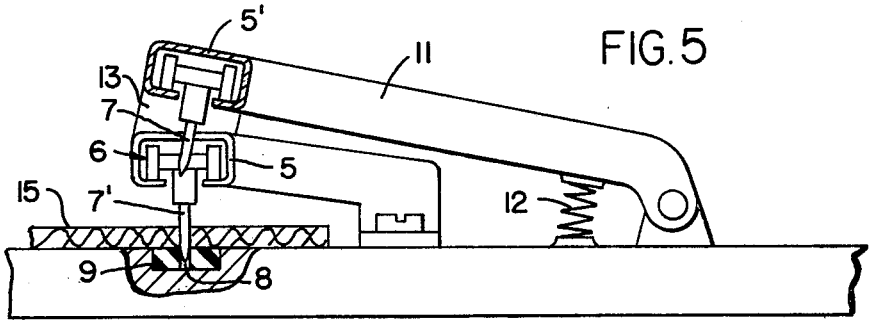
FIG. 5 is a partial side elevational view taken along line 5—5 of FIG. 4.

In one of the embodiments of the invention as shown in FIGS. 1 thru 5, there is provided a sewing machine 1 which has edge guide means 2. The edge guide means is of the type which automatically shifts the material laterally in response to pneumatic sensing of the position of the edge of the material at any instant relative to the needle of the sewing machine. There also is provided by the present invention a table top 4 and guide rail means 5. The guide rail means 5 makes a complete closed loop, running at its first end means 100 parallel to the table top 4. The guide rail means 5 runs in a direction from the material loading station 70 through the sewing station 71 then rising to a height from which it gradually descends to the material loading station. The guide rail serves to guide and carry a plurality of securing assemblies (FIG. 3).

Figure 4:
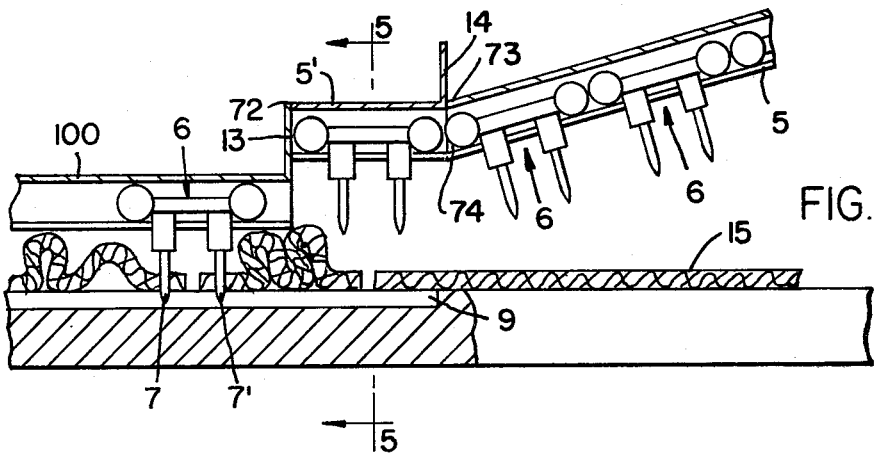
FIG. 4 is a sectional view taken along line 4—4 of FIG. 2 showing the stapling device in detail.

As particularly shown in FIGS. 3, 4, and 5 the securing means 6 are in the form of connecting links 6. The connecting links or slides 6 are provided with two needles 7 and 7′ which depend from the link 6 and engage in slot 8 of strip 9 when the connecting link 6 is in the section of the guide rail means 5 that is parallel to the table top. Strip 9 is located in table top 4, extending from the material loading station 70 through the sewing station 71 and is parallel to the guide rail means section 100.

At the material loading station, a section 5′ of the guide rail means 5, is attached to lever arm 11, which is urged to a raised position by spring 12, as shown in FIG. 5, so that this assembly acts as a stapling device. Section 5′ of the guide rail means 5 is not secured to the rest of the guide rail 5. The length of section 5′ is equal to the length of one connecting link 6. In the raised position, the end 72 toward the section 100 of the guide rail means 5 which is parallel to the table top 4 is closed by a plate 13 that is attached to the table top section 100 of the guide rail means 5. In the raised position, the opposite end 73 of the section 5′ of the rail 5 is in line with the other end 74 of guide rail means 5 that it is elevated so that a connecting link 6 will slide into movable section 5′ of the rail.

On the movable section 5′ or stapling section of the rail is a plate 14 which, when section 5′ is lowered, blocks off the end of the elevated section of guide rail means 5. Section 5′ of the rail forms a magazine in which the connecting links 6 collect one at a time. Lowering of section 5' of the rail may be selectively effected manually or by pushing a button whereby means could be employed for electrically or pneumatically operating the lowering of the stapling device. The slide 6 is advanced by the operator from the movable section 5' of the rail in its lowered position, into the end of the guide rail which is parallel with the table top section. The movable section 5' of the rail now is returned to its raised position and ready to accept the next connecting link 6.

Before the movable section 5' or the stapling section of the rail is lowered, the trailing edge of the leading workpiece and the leading edge of the trailing workpiece are aligned by the operator by means of guideline markings beneath the movable section 5' on the table top 4. The movable section 5' of the rail is lowered, connecting the two workpieces together with a connecting link 6, the operator then advances the connecting link 6 from the movable section 5' of the rail into the table top section 100 of the guide rail before returning the movable section 5' of the rail to its raised position. The trailing workpiece is bunched together as shown in FIG. 4 so its trailing edge can be aligned with the leading edge of another workpiece and they can be connected together as previously described. The stapler being remote from the stitching area allows a number of workpieces to be bunched.

As the workpiece is fed through the stitching area, it is automatically shifted laterally by the edge guide 2 to insure that the stitching is performed at a constant distance from the edge of the workpiece.

Turning again to FIGS. 3 through 5, as the material 15 is sewn it is moved by the feeding instrumentalities of the sewing machine carrying along with it the connecting links 6. The connecting links 6 moving in the guide rail means 5 that is parallel to the table top 4 have the points of the needles 7 and 7' extending down into the slot 8 of strip 9 to prevent the needles 7 and 7' from coming out of the material. After passing through the stitching zone the connecting link 6 arrives at the rising section of the guide rail means 5. Belt 17, located just above the rising section, is guided by rollers 18 and is driven by sewing machine 1 at sewing speed by any suitable means. Equally spaced and attached to the belt are a plurality of depending members or catchers 16, that extend down into the rising section of the guide rail means 5 and catch the back 75 of the connecting link 6 and drive them up to the highest point of the guide rail whereby a force is transferred to the carrier means 6. As the connecting link 6 moves upward, the material temporarily gripped by the needles 7 and 7' is released when it meets plate 19 that is mounted on guide rail means 5. From the highest point the connecting links 6 move down by means of gravity to the movable section 5' of the guide rail means 5 such that a staging area is formed.

Figure 6:
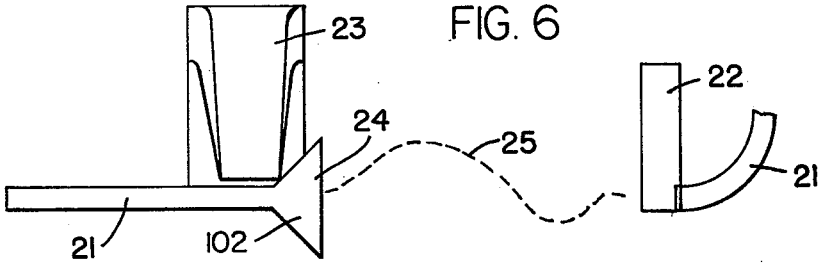
FIG. 6 is a diagrammatic top plan view illustrating another embodiment of a feeding apparatus according to the present invention.

Referring to FIG. 6 wherein another embodiment of the invention is shown, there is no guide rail 21 between the sewing machine 23 and the movable section of the rail 22. The guide rail 21, in FIG. 6 is directly in front of and extending to the rear of the sewing machine 23, the first end means 102 of guide rail 21 is formed as a funnel-like catcher 24. There being no guide rail 21 between the sewing machine 23 and the magazine 22, permits the connector means 6, not shown in FIG. 6, to move freely between the magazine 22 and the sewing machine 23. This is necessary when the edge of the material being sewn is not a straight line. Thus it will be necessary to move the connector means along a path 25, FIG. 6 in order to impart sideways motion so the contour of the edge will be correctly sewn. Such a path may consist of a magnetic track or an appropriately shaped guide rail such as 9 in FIG. 5 in which the connector means is moved.

Figure 7:
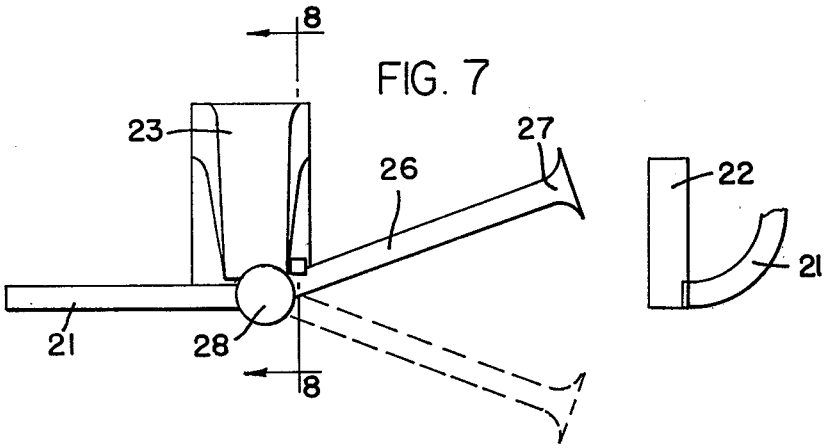
FIG. 7 is a diagrammatic top plan view showing yet another embodiment of a feeding assembly according to the present invention.
Figure 17:
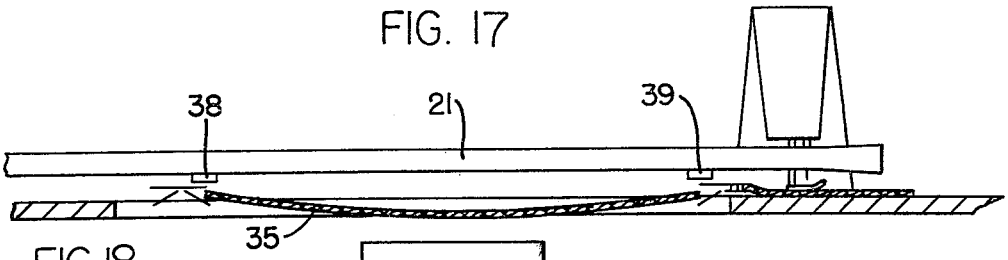
FIG. 17 is a fragmentary front elevation view showing the material releasing device in a third position.
Figure 18:
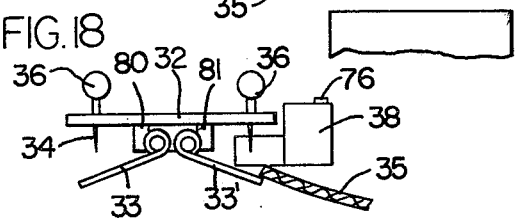
FIG. 18 is a fragmentary front elevation detail view showing the second material releasing device in a third position.
Figure 19:
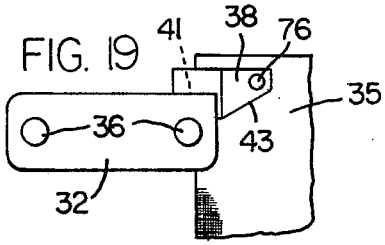
FIG. 19 is a fragmentary top plan detail view showing the device in FIG. 18.
Figure 20:
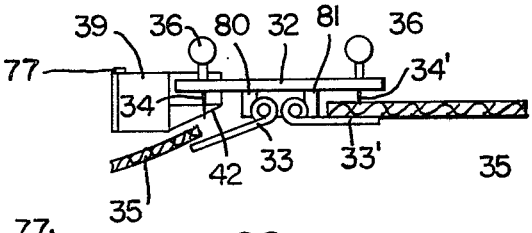
FIG. 20 is a fragmentary front elevation detail view showing the first material releasing device in releasing position.

In FIGS. 7 & 8 there is shown another embodiment of the invention. In FIG. 7 there is shown a pivotal piece 26 of guide rail arranged between the sewing machine 23 and the stapling device 22. The guide rail 26 is pivoted at the sewing machine and its free end 27 is formed as a funnel-like catcher in its horizontal plane. The pivotal piece 26 is coupled to a positioning motor 28 which is connected to a control box 29 (FIG. 8). The control box 29 may contain an exchangeable program control that will direct the positioning control motor 28 to swing the pivotal piece 26 of rail to keep the edge of the material being sewn at an equal distance from the needle at all times during the passage of the material through the sewing machine. The connector means is at this time contained in the pivotal piece 26. As shown in FIG. 8 the control of the positioning motor 28 may also be affected by the sensors 31, FIG. 8, located in front of the stitching zone, which scans the edge of the material, feeding signals to the control box which in turn feeds the positioning control motor 28 in accordance with the contour of the edge of the material.

FIGS. 9 through 26 and FIGS. 29 and 30 show the apparatus necessary for releasing the material, after sewing, from the connector means. As may be best seen in FIG. 10 connector means consist of a carrier assembly means 32 onto which clamps 33 and 33' are hinged at center section 32' of carrier assembly 32. The carrier 32 has two needles 34 and 34', each one associated with one of the hinged clamps 33 and 33', for holding the pieces of material 35. Above the carrier 32, in line with the needles 34 and 34' there are slides 36 for sliding the carrier assembly in the guide rail 21. Past the sewing area, above the rail 21, a conveyor belt 37, containing a plurality of equally spaced depending members or catchers 40, is driven at sewing speed by any suitable means. The catchers 40 extend down into the rail 21 and catch the back of the slides 36 and move them.

Figure 29:
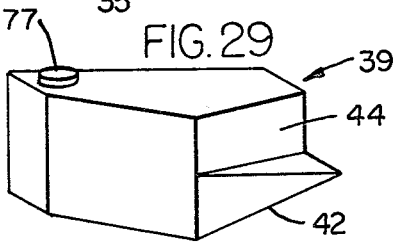
FIG. 29 is a perspective view showing first releasing block.
Figure 22:
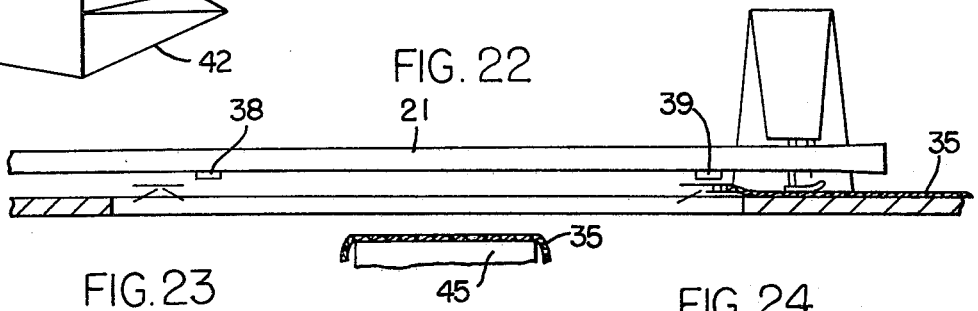
FIG. 22 is a fragmentary front elevation view showing the material releasing device just after release.
Figure 23:
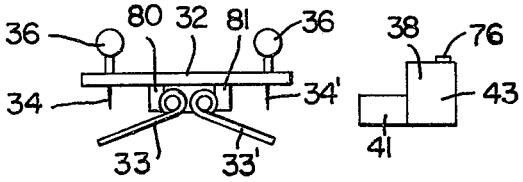
FIG. 23 is a fragmentary front elevation detail view showing the second material releasing device just after release.
Figure 24:
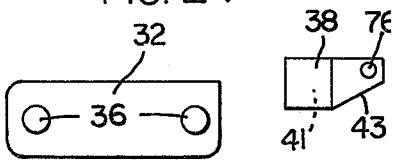
FIG. 24 is a fragmentary top plan detail view showing the device in FIG. 23.
Figure 25:
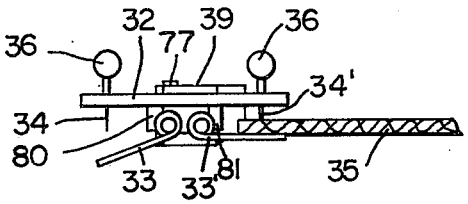
FIG. 25 is a fragmentary front elevation detail view showing the first material releasing device just after release.

Located nearest the sewing machine is an opener 39. FIGS. 9, 12, 13, 20, 21, 25 and 26 depict the movement of opener 39 during the sewing cycle. Opener 39 is pivotally supported and carried on the underside of the rail 21 by pivot pin 77. Opener 39 contains inclined surfaces 42 and 44 (FIG. 29). Located at the other end (left in FIG. 9) of the conveyor belt 37 is another opener 38. FIGS. 9, 10, 11, 15, 16, 18, 19, 23 and 24, depict the movement of opener 38 during the sewing cycle. Opener 38 is pivotally supported on the underside of the rail 21 by pivot pin 76. Opener 38 contains inclined surfaces 41 and 43 (FIG. 30).

As is best shown in FIGS. 9 through 13, the end 78 and beginning 79 of two adjoining pieces of material 35 are stabbed at their ends onto the needles 34 and 34' and the clamping parts 33 and 33' are swung up against the needles. Retainer parts which may be in the form of permanent magnets 80 and 81 in the carrier 32 hold the clamps 33 and 33' in the closed position.

Once the connector assembly 32 has passed by the sewing area the rear side (FIG. 10) of the slide 36 is engaged and pushed to the left, was viewed in FIG. 9, by the catcher 40. As mentioned above the catchers 40 are carried by the conveyor belt 37. The openers 38 and 39 are urged by spring means into the positions shown in FIGS. 11 and 13 respectively. In FIGS. 10 and 11 there is shown the positioning of connector assembly 32, which carries one end 104 of the material workpiece with respect to opener 38. The opener 38 has an abutting surface 43 which projects into the path of the connector means. As seen in FIGS. 15 and 16, as soon as a connector means abuts against the surface 43 the opener 38 pivots in a clockwise direction about pivot pin means 76 so that the forward clamping part 33, which is in its opened position due to its passing by opener 39, moves past the inclined surface 41 without the opener 38 having to act thereupon. Drawing attention now to FIGS. 18 and 19, once the carrier 32 has passed the abutting surface 43 the opener 38 swings back into the position shown under the influence of the spring. The inclined surface 41 thereupon forces the rearward clamping part 33' downward whereby the leading end 104 of the piece of material 35 is released.

Figure 21:
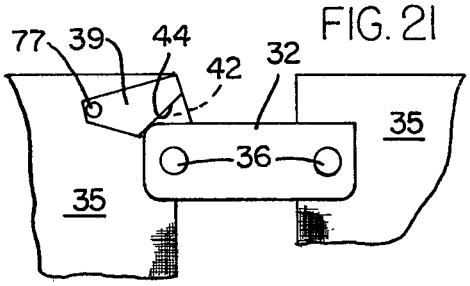
FIG. 21 is a fragmentary top plan detail view showing the device in FIG. 20.
Figure 26:
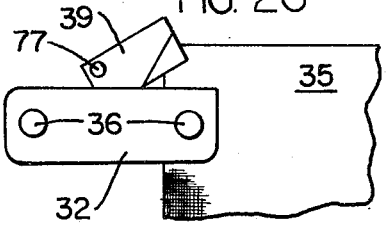
FIG. 26 is a fragmentary top plan detail view showing the device in FIG. 25.

Turning now to FIGS. 12 and 13 the rearward end 78 of the material 35 is clamped by the carrier assembly means 32. The carrier assembly 32 is effected for releasing the material by means of a second opener means 39. The opener means 39 includes inclined surfaces 42 and 44 which lie in the path of motion of the connector means 32. The purpose of the inclined surface 42 is to release the trailing edge of the workpiece. First contact between connector means 32 and opener 39 is made between inclined surface 42 and forward clamp 33 (FIG. 20) resulting in forward clamp 33 swinging downward thereby releasing the trailing end 78 of the piece of material 35. At this same time the moving carrier 32' abutts inclined surface 44 resulting in opener 39 swinging in a counterclockwise direction about pivot pin 77 and out of the path of the carrier 32. FIG. 21 shows the beginning of this action and FIG. 26 shows the final position of opener 39. Opener 39 remains in this position until the carrier 32 has completely passed the opener 39 and then the opener 39 returns to its normal position, that is the inclined surface means 42 is removed from effecting opening of the latter clamp 33 thus is not capable of effecting the beginning edge of the workpiece.

Openers 38 and 39 are positioned such that opener 39 releases forward clamping part 33 just before or at the same time that opener 38 releases rearward clamping part 33 therefore releasing the piece of material 35 and dropping it on stacking rest 45.

Figure 27:
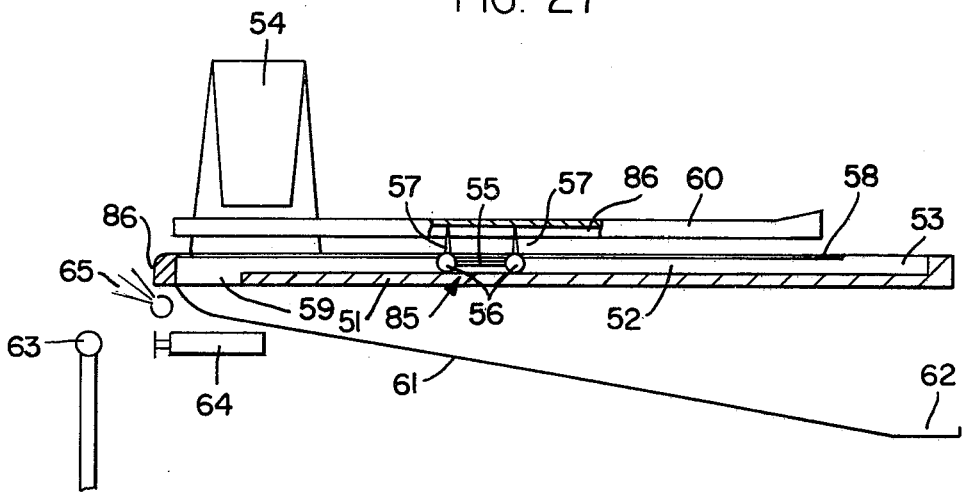
FIG. 27 is a diagramatic front elevation view showing another embodiment of a feeding assembly according to the present invention.
Figure 28:
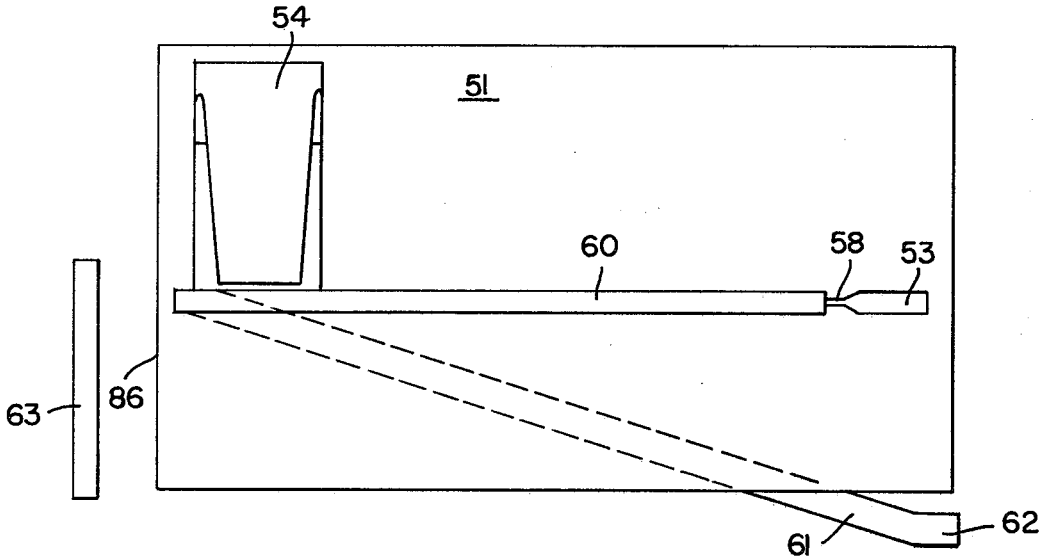
FIG. 28 is a diagramatic top plan view showing the apparatus in FIG. 27.

Referring to FIGS. 27 and 28 wherein another embodiment of the invention is shown, a table top 51 contains a guide 52 located at the left side of a sewing machine. The guide 52 extends from a feed station 53 past the sewing machine to a downward opening 59. Connector assembly means 85 for the piece of material, not shown, includes a connecting link 55 and two ball means 56. The ball means 56 have projecting upward needle like points 57. The ball means 56 are enclosed in guide 52 with the points projecting upward through a slot 58. The slot 58 continues the whole length of the guide 52 being wider at the feed station 53 so the connecting links 55 can be inserted.

The guide 52 is overlaid by a slotted coverstrip 60 in which the points 57 engage in order to prevent the release of the pieces of material that the points have gone through.

Underneath the opening 59 is a chute 61 which extends from the opening 59 down to a magazine means 62 that is located below and to the left of the feed station 53. Below the opening 59 at the back end of the table top 51 there is a stacker, known in the art, consisting of a bar 63, a clamping part 64 which moves according to the flow of the pieces of material and an air jet tube 65 containing a plurality of air nozzles.

After leaving the sewing area, only the connector means drop through the opening 59 releasing the material and moves down the chute 61 and arrives at the magazine 62 for reuse. They are picked up by the operator and inserted into the feed station with the needles up such that the forward needle penetrates the trailing edge of forward piece of material and the trailing needle penetrates the leading edge of the trailing piece of material.

After the piece of material has been sewn its leading edge hangs down over the back edge 86 of the table top 51 and at the correct time the clamping part 64 moves out and clamps the workpiece against the bar 63 while at the same time air out of the air nozzle of the air jet tube 65 blows the trailing edge of the workpiece over the bar 63.

Thus it is apparent that there has been provided in accordance with the present invention a method and apparatus for continually and automatically feeding material workpieces one after another to and through a sewing machine for a sewing operation along an edge of each workpiece that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. In combination with a sewing machine mounted on a table top having stitch forming instrumentalities, a feed mechanism for feeding material workpieces to said stitch forming instrumentality, and an edge guide means for guiding an edge of said workpieces to said stitch forming instrumentalities, an apparatus mounted on said table top being selectively operable to continuously feed workpieces to said instrumentalities, comprising:

guide rail means, a portion of which passes through said stitch forming instrumentalities;

means carried by and guided through said stitch forming instrumentalities by said guide rail means and adapted to secure a plurality of workpieces together so that the movement imparted to said workpieces by said feed mechanism means continuously draws the next succeeding workpiece into the stitch forming instrumentalities to be sewn.

2. An apparatus as in claim 1 wherein said guide rail means includes a loading station means, guiding section means, releasing conveyor station means and a return section means.

3. An apparatus as in claim 1 wherein said securing means is a connecting link with pin like projections depending therefrom.

4. An apparatus as in claim 1 wherein said return section means, and said guiding section means of said guide rail means is an endless rail.

5. An apparatus as in claim 1 wherein said loading station means includes a pivotally movable lever arm with a section of rail attached.

6. An apparatus as in claim 5 wherein said section of rail communicates with the ends of the said rail at different elevations.

7. An apparatus as in claim 6 wherein said section of rail is equal in length to the length of said securing means.

8. An apparatus as in claim 2 wherein said guiding section means is a stationary section of rail running parallel to said table top and closely adjacent said sewing instrumentality.

9. An apparatus as in claim 2 further including a guide strip means which extends from the said loading station means through said releasing conveyor station means into which the said pin like projection of the said connecting link engage in.

10. An apparatus as in claim 2 wherein said releasing conveyor station includes a belt driven by said sewing machine, said belt including a plurality of equally spaced depending member which engage a portion of said securing means.

11. An apparatus as in claim 2 wherein said return section means is a downward sloping rail.

12. An apparatus as in claim 1 wherein said guide rail means is mounted on said table top, and includes a loading station means, guiding section means, releasing conveyor station means, and a return section means; and said guiding section means consists of said guide rail means being interrupted between said loading station means and said sewing machine, one end of said guide rail means at the said sewing machine is formed as a funnel like catcher, and a control means to displace the said securing means sideways.

13. An apparatus as in claim 12 wherein said securing means is a connecting link with pin like projections.

14. An apparatus as in claim 12 wherein said loading station means includes a pivotally movable lever arm with a section of rail attached thereto.

15. An apparatus as in claim 14 wherein said section of rail communicates with the end of said return section guide rail means and said guide rail means at different elevations.

16. An apparatus as in claim 15 wherein said section of rail is equal in length to the length of said connecting link.

17. An apparatus as in claim 12 wherein said releasing conveyor station includes a belt driven by said sewing machine, said belt including a plurality of equally spaced depending members which engage a portion of said securing means.

18. An apparatus as in claim 12 wherein said return section means is a downward sloping rail.

19. An apparatus as in claim 1 wherein said guide rail means is mounted on said table top and includes a loading station means, guiding section means, releasing conveyor station means, and a return section means; and said guiding section means is a pivotally mounted in front of said machine and extends to said loading station means, its free end having a funnel like catcher, and a positioning drive means connected to said pivotal piece of rail.

20. An apparatus as in claim 19 wherein said securing means is a connecting link with pin like projections.

21. An apparatus as in claim 19 wherein said loading station means includes a pivotally movable lever arm with a rail attached thereto.

22. An apparatus as in claim 21 wherein said section of rail communicates with the end of said return section guide rail means and the said guide rail means at different elevations.

23. An apparatus as in claim 22 wherein said section of rail is equal in length to the length of said connecting link.

24. An apparatus as in claim 19 wherein said releasing conveyor station includes a belt driven at sewing speed, said belt including a plurality of equally spaced depending members which engage a portion of said securing means.

25. An apparatus as in claim 19 wherein said return section means is a downward sloping rail.

26. An apparatus as in claim 19 wherein said positioning drive means is a positioning motor controlled by an exchangeable program control.

27. An apparatus as in claim 19 wherein said positioning drive means comprising a positioning motor controlled by sensors located in front of the stitching zone which scan the edge of the said workpiece.

28. An apparatus as in claim 1 wherein said guide rail means is mounted on said table top and includes a loading station means, guiding section means, releasing conveyor station means, rising section means, and a return section means;

said securing means includes a carrier containing hinged clamps associated with needles; and said releasing conveyor station consists of a horizontal rail for carrying said carriers, a belt containing a plurality of catchers that extend down into the said guide rail driven by roller means, and opener means containing inclined surfaces for releasing said material from said clamps.

29. An apparatus as in claim 28 wherein said loading station means includes a pivotally movable lever arm with a section of rail.

30. An apparatus as in claim 29 wherein said section of rail communicates with the end of said return section guide rail means and the said guiding section means at different elevations.

31. An apparatus as in claim 30 wherein said section of rail is equal in length to the length of said connecting link.

32. An apparatus as in claim 28 wherein said rising section means consists of a rising section of said guide rail means associated with a belt containing a plurality of equally spaced catchers that extend down into the said guide rail driven by rollers at sewing speed.

33. An apparatus as in claim 28 wherein said return section means is a downward sloping rail.

34. An apparatus as in claim 1 wherein said guide rail guide means is contained on the top of said table top;

said guide rail means extends from a feed station through the sewing zone to a downward opening in the said sewing table means;

said guide means is overlaid by a slotted cover strip extending from just past the said feed station through the downward opening, into which the securing means engage; and said downward opening connects to a chute extending down to a magazine located below said feed station.

35. A method for automatically and continually feeding material workpieces one after another to an automatic sewing machine for a sewing operation along an edge of said workpiece comprising the steps of:

connecting trailing edge of one said workpiece to the leading edge of the following said workpiece by a connector means; advancing said workpieces to a guiding means, a portion which passes through said sewing machine;

advancing said workpieces to the point of sewing operation by the feed mechanism of said sewing machine;

moving the edge of said workpiece to be sewn as said edge approaches said sewing machine; guiding said workpiece one after another through said sewing machine; sewing said workpiece proximate its edge of said workpiece; and then disconnecting said workpiece from one another.

* * * * *